United States Patent [19]

Sloan

[11] Patent Number: 4,529,359

[45] Date of Patent: Jul. 16, 1985

[54] SEWERAGE PUMPING MEANS FOR LIFT STATION

[76] Inventor: Albert H. Sloan, 4200 Kean Rd., Fort Lauderdale, Fla. 33314

[21] Appl. No.: 490,843

[22] Filed: May 2, 1983

[51] Int. Cl.[3] ..... F04B 49/00; F04B 49/04; F04B 9/08

[52] U.S. Cl. ..... 417/34; 417/10; 417/40; 417/47; 417/390; 417/405

[58] Field of Search ..... 417/10, 16, 34, 40, 417/47, 364, 390, 405, 426

[56] References Cited

U.S. PATENT DOCUMENTS

| | | | |
|---|---|---|---|
| 2,810,345 | 10/1957 | Englesson | 417/426 X |
| 3,644,916 | 2/1972 | Payne, Sr. | 417/63 |
| 3,907,463 | 9/1975 | Eller et al. | 417/372 X |
| 3,910,728 | 10/1975 | Sloan | 417/405 X |
| 3,941,507 | 3/1976 | Niedermeyer | 417/40 X |
| 4,060,341 | 11/1977 | Tremain et al. | 417/89 X |
| 4,201,524 | 5/1980 | Wilkins | 417/364 |
| 4,422,829 | 12/1983 | Buchanan | 417/40 |

FOREIGN PATENT DOCUMENTS

| | | | |
|---|---|---|---|
| 909297 | 4/1954 | Fed. Rep. of Germany | 417/364 |
| 321840 | 10/1934 | Italy | 417/364 |
| 54-15521 | 2/1979 | Japan | 417/15 |
| 1406306 | 9/1975 | United Kingdom | 417/426 |

*Primary Examiner*—William L. Freeh
*Assistant Examiner*—Paul F. Neils
*Attorney, Agent, or Firm*—James E. Nilles

[57] ABSTRACT

Sewerage pumping apparatus is provided for delivering sewerage collected by gravity in a wet well to a force main which supplies sewerage by force to a remotely located sewerage treatment plant. The sewerage pumping apparatus comprises a hydraulically driven submersible pump located in the wet well for supplying sewerage to the force main. Two trailer-mounted hydraulic pump units (main and standby) adjacent the wet well are alternatively operable to supply pressurized hydraulic fluid to drive the submersible pump. Check valves prevent the operative pump unit from supplying hydraulic fluid to the inoperative pump unit. The main pump unit is driven by an electric motor energized from a nearby electric utility power line. The standby pump unit is driven by an internal combustion engine. Float switches sense the sewerage level in the wet well and regulate operation of the in-service pump unit (and submersible pump) accordingly. Apparatus, including an emergency float switch, is provided for sensing an electrical utility power failure which renders the electrically driven main pump unit inoperative and for starting the engine for the standby pump unit to thereby maintain the submersible pump in operation.

4 Claims, 7 Drawing Figures

SEWERAGE PUMPING MEANS FOR LIFT STATION

BACKGROUND OF THE INVENTION

1. Field of Use

This invention relates generally to sewerage disposal systems which include a gravity-fed wet well at a lift station and, particularly, to improved sewerage pumping apparatus for delivering sewerage from the wet well to a force main which forcibly feeds the sewerage to a sewerage treatment plant located remote from the lift station.

2. Description of the Prior Art

In one known type of sewerage disposal system, sewerage from a plurality of primary sources such as homes or dwellings is supplied by gravity through a plurality of sloped primary mains or conduits to a main collection hole or pit. Sewerage from the pit is then supplied by gravity through a sloped secondary main or conduit to a wet well which is part of a lift station. The lift station further includes sewerage pumping means which supplies sewerage from the wet well to a force main, for example, which forcibly delivers it by gravity to a collection tank at a sewerage treatment plant. Lift stations are required because a point is reached where it becomes impractical to lay gravity-flow sewer lines any deeper underground. In practice, such a known sewerage system typically comprises a plurality of pits for supplying each wet well and a plurality of wet wells for supplying each treatment plant. Also, lift stations may be provided for the force main. Furthermore, the primary mains may, for example, be up to several hundred feet in length, the secondary main up to several miles in length, and the force main up to 30 miles in length.

In such prior art sewerage systems the prior art sewerage pumping means for delivering sewerage from the wet well to the force main takes various forms. For example, sometimes electrically driven submersible pumps located in the wet well and energized from a nearby electric utility power source are used. Or, submersible pumps driven by a hydraulic motor supplied from a hydraulic pump on the surface are used. In the latter case the hydraulic pump on the surface is driven by an electric motor energized from a nearby electric utility power source. However, electric power outages, which are becoming increasingly more common and which can last anywhere from several minutes, hours or even days, interfere with operation of any submersible pump which ultimately depends on energization from the electric utility and can cause sewerage back-up and overflow from the wet well with obvious undesirable consequences in the vicinity of the lift station. One prior art solution to overcome the electric power outage problem is to provide a standby engine-driven generator at the lift station to provide emergency electric power in case of a power outage on the utility lines. However, since the electric motors to be powered by the engine-driven generator typically draw on starting up to 400 percent of the power needed for normal running, the engine-driven generator must be an oversized expensive machine which can cost more than all the rest of the equipment at the lift station. Such a machine is infrequently used and, even then, seldom at full capacity.

SUMMARY OF THE INVENTION

Sewerage pumping apparatus in accordance with the present invention for delivering sewerage from a wet well at a lift station to a force main or the like in a sewerage system comprises a submersible pump including a hydraulic drive motor for disposition in the wet well and operative for supplying sewerage to the force main. The apparatus further comprises a main pump unit including an electric motor energizable from electric utility power supply lines and a hydraulic pump for supplying pressurized hydraulic fluid to operate the submersible pump, and a standby pump unit including an internal combustion engine and a hydraulic pump for supplying pressurized hydraulic fluid to operate the submersible pump in the event the main pump unit is rendered inoperative because of a failure or outage of the electrical power supply which energizes the electric motor of the main pump unit. The apparatus also comprises means, including an emergency float switch, responsive to wet well near-overflow and indicative of an electrical power supply failure which renders the main pump unit inoperative. These means operate to start the engine of the standby pump unit to maintain the submersible pump in operation. The sewerage pumping apparatus also includes a hydraulic circuit connected between the hydraulic drive motor of the submersible pump and the hydraulic pumps of both the main and standby units, and this hydraulic circuit includes check valve means for preventing the operative pump unit from delivering hydraulic fluid into the inoperative unit. The sewerage pumping apparatus includes means, including float switches, for sensing the sewerage level in the wet well and for regulating the on/off operation of whichever pump unit is in service so as to adjust the output of said submersible pump and maintain the sewerage at a safe level.

Improved sewerage pumping apparatus in accordance with the invention offers numerous advantages over the prior art. For example, the improved apparatus employs a low-cost internal combustion engine for driving a hydraulic pump in the standby unit for driving the hydraulically operated submersible pump in the wet well, instead of a costly, overrated engine-driven electrical generator needed to power an electrically driven submersible pump. Furthermore, use of a hydraulically driven submersible pump in the wet well, instead of an electrically driven submersible pump, enables design and construction of a relatively smaller but much more powerful submersible pump which is capable of easily being operated at variable speeds. Furthermore, a hydraulically driven submersible pump cannot be short-circuited as can an electrically driven pump and, since the hydraulic operating fluid supplied thereto is at high pressure relative to the liquid sewerage in the wet well, water tends not to seep into the hydraulic motor. Another advantage is that both the main and standby pump units conveniently and economically share a common hydraulic circuit comprising hydraulic supply and return lines to the submersible pump. However, check valves in the hydraulic circuit prevent cross-feed of hydraulic fluid from the operative to the inoperative pump units. Another advantage in using a hydraulically driven submersible pump supplied from a pump driven by an electric motor or by an internal combustion engine is a wide range of speed regulation is possible; whereas in prior art standby systems wherein an engine-driven electric generator supplied an electrically driven submersible pump, speed regulation was difficult and costly to obtain because the generator needed to be driven at a relatively constant speed. In the present invention, speed regulation is easily obtained to modulate the speed of the hydraulic submersible pump. Also, if the wet well is accidentally pumped dry, or the pump is stalled, a hydraulically driven submersible pump if run while dry is self-cooled by the hydraulic flow therethrough, whereas many electric submersible pumps will burn up if run while dry. Another advantage is that, whereas the hydraulic submersible pump can be designed, built and operated to deliver constant or variable power, or constant or variable speed, it can still be ultimately driven by a slow-speed, heavy-duty, relatively inexpensive industrial electric motor in the main hydraulic pump unit. On the other hand, electric submersible pumps have inherent design limitations and very often can only run at a constant speed. Other objects and advantages of the present invention will hereinafter appear.

DRAWINGS

DESCRIPTION OF PREFERRED EMBODIMENT

Figure 1:
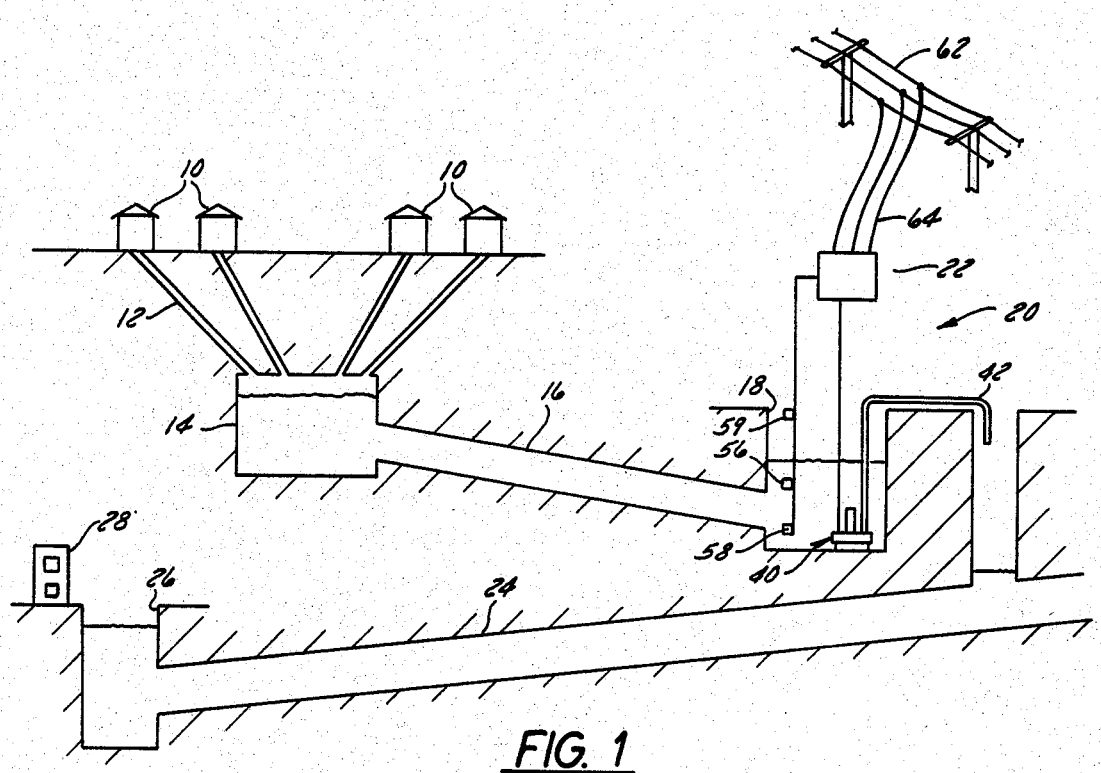
FIG. 1 is a schematic diagram of a sewerage disposal system employing sewerage pumping means in accordance with the present invention.

Referring to FIG. 1, there is shown in schematic form (and not to scale) a sewerage system in accordance with the invention which is generally arranged as follows. Sewerage from a plurality of primary sources such as homes or dwellings 10 is supplied therefrom by gravity through a plurality of sloped primary mains or conduits 12 to a main collection hole or pit 14. Sewerage from pit 14 is supplied therefrom by gravity through a sloped secondary main or conduit 16 to a wet well 18 which is part of a lift station 20. Lift station 20 further includes sewerage pumping means 22 in accordance with the invention which supplies sewerage from wet well 18 to a sloped force main 24 and from thence by gravity to a collection tank 26 at a sewerage treatment plant 28. In practice, a sewerage system may comprise a plurality of pits 14 for each wet well 18 and a plurality of wet wells 18 for each treatment plant 28. Lift stations may be provided for the force main 24, if need be. Furthermore, the primary mains 12 may, for example, be up to several hundred feet in length, the secondary main 16 up to several miles in length, and the force main 24 up to 30 miles in length.

Figure 2:
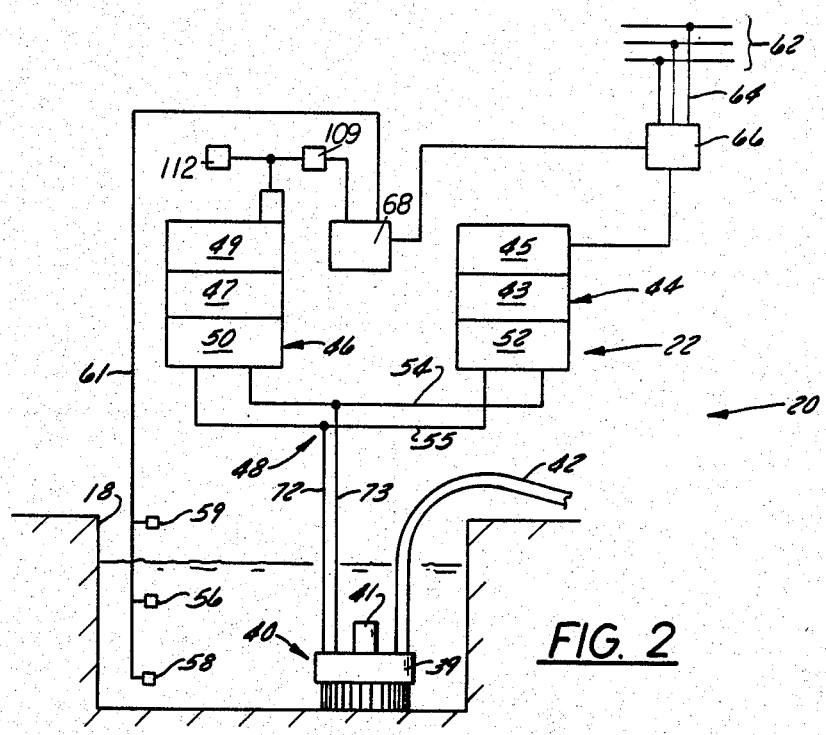
FIG. 2 is an enlarged schematic diagram of the sewerage pumping means shown in FIG. 1.

As FIGS. 1 and 2 show, lift station 20 forming part of the sewerage disposal system includes wet well 18 and sewerage pumping means or apparatus 22 for delivering sewerage collected by gravity in wet well 18 to force main 24 which supplies sewerage under gravity to the storage tank 26 of remotely located sewerage treatment plant 28. The sewerage pumping apparatus generally comprises a hydraulically driven submersible pump 40 located in wet well 18 for supplying sewerage through a sewerage conduit 42 to the force main 24. The sewerage pumping apparatus 22 further comprises two trailer-mounted hydraulic pump units 44 and 46 alternatively operable to supply pressurized hydraulic fluid through a hydraulic circuit 48 to drive the submersible pump. The hydraulic circuit 48 includes check valve assemblies 50 and 52 and an interconnecting circuit 54 to prevent the operative hydraulic pump unit 44 or 46 from supplying hydraulic fluid to the inoperative pump unit. One hydraulic pump unit 44 is a main unit and comprises a hydraulic pump 43 driven by an electric motor 45 energized from an electric utility. The electric utility includes pole-mounted power lines 62 which are connected by drop-lines 64 to a motor controller 66 for electric motor 45. The other hydraulic pump unit 46 which is a standby unit comprises a hydraulic pump 47 driven by an internal combustion engine 49. The sewerage pumping apparatus 22 also comprises float switches 56 and 58 for sensing the level of sewerage in the wet well 18 and a speed control circuit 60 responsive thereto through conductor 61 for regulating the operation of the operative hydraulic pump unit 44 or 46 to control the submersible pump 40 output accordingly. The sewerage pumping apparatus 22 further comprises apparatus 68 for sensing an electrical utility power failure which renders the electrically driven pump unit 44 inoperative and for starting the engine 49 for the standby pump unit 46 to render the latter operative and maintain the submersible pump 40 in operation. The apparatus 68 responds to actuation of an emergency float switch 59 in wet well 18.

As FIGS. 2, 3, 4 and 5 show, the hydraulically driven submersible pump 40 comprises a centrifugal pump 39 on which is mounted a hydraulic motor 41 for driving a semi-open impeller 37 in the pump 39 at a variable speed. Hydraulic motor 41 comprises hydraulic fluid inlet and outlet ports 70 and 71, respectively, which are connected to the lower ends of hydraulic fluid pressure and return lines 72 and 73, respectively, which are part of hydraulic circuit 48. Submersible pump 40 can be operated at variable speeds. Centrifugal pump 39 comprises liquid inlet and outlet ports 75 and 76, respectively. Inlet port 75 communicates directly with the liquid sewerage in wet well 18. Outlet port 76 is connected to the lower end of sewerage conduit 42 whose upper end is shown inserted into an opening in force main 24. Conduit 42 takes the form of a flexible hose having an inside diameter of about 3 inches, for example. Pump 40 is connected to a cable 80 by means of which it is lowered into, suspended in and raised from wet well 18.

Figure 3:
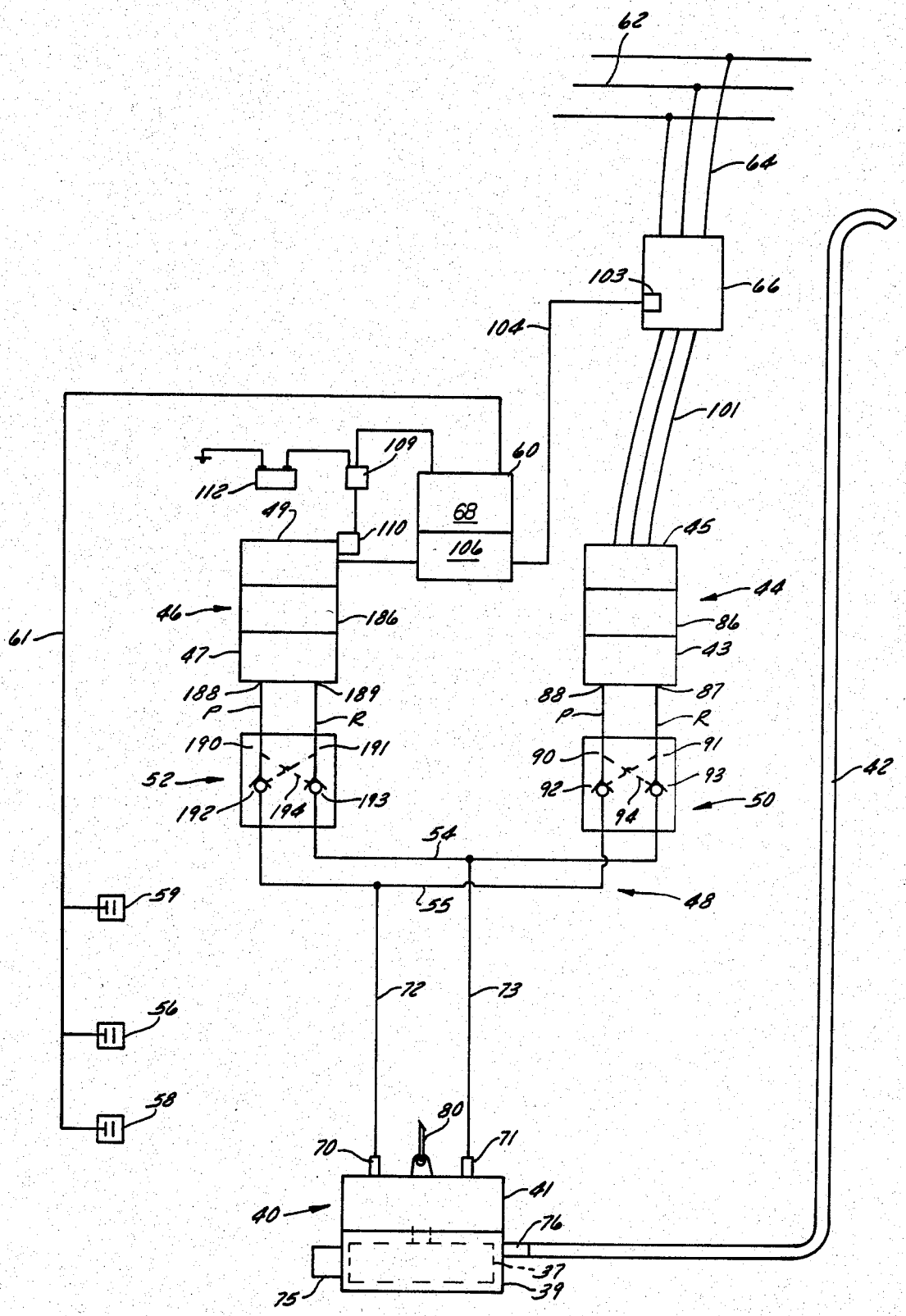
FIG. 3 is an enlarged schematic diagram of a portion of the hydraulic circuit of the sewerage pumping means shown in FIG. 2.
Figure 4:
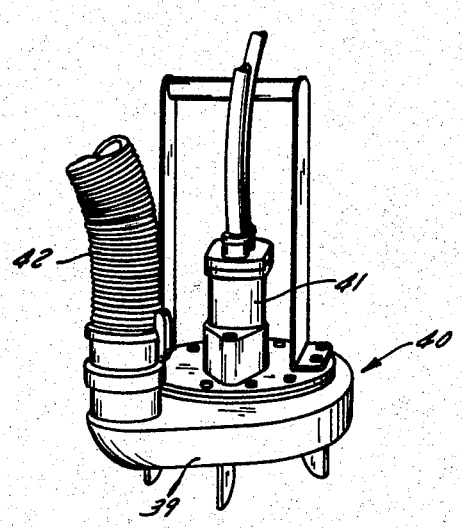
FIG. 4 is an enlarged perspective view of the top and side of a hydraulically driven submersible sewerage pump shown in FIGS. 1 and 2.
Figure 5:
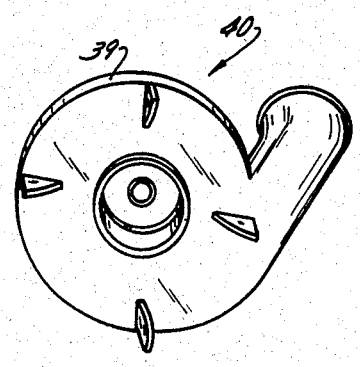
FIG. 5 is a perspective view of the bottom of the submersible pump of FIG. 3.
Figure 6:
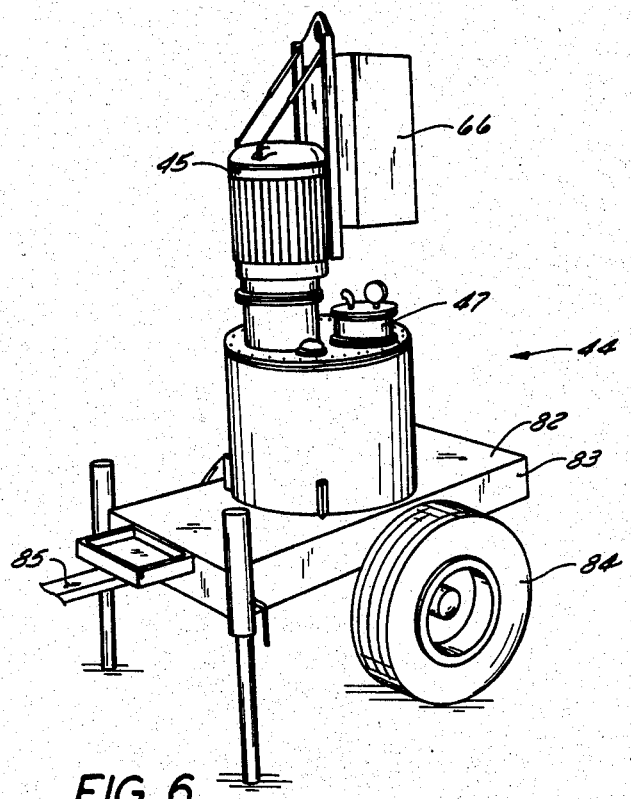
FIG. 6 is a perspective view of a trailer-mounted electrically driven main hydraulic pump unit of FIGS. 1, 2 and 3.
Figure 7:
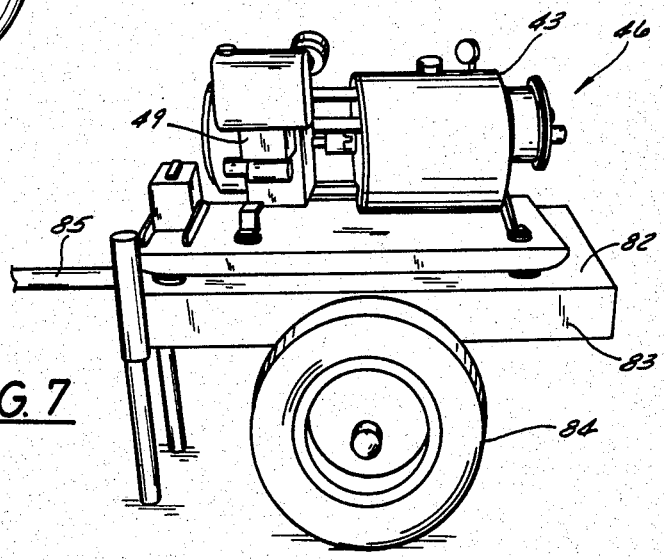
FIG. 7 is a perspective view of a trailer-mounted internal combustion engine-driven standby hydraulic pump unit of FIGS. 1, 2 and 3.

As FIGS. 1, 2, 3 and 6 show, the main electrically driven hydraulic pump unit 44 comprises a hydraulic pump 43 which is connected to be driven by an electric motor 45. Motor 45 takes the form of a commercially available constant speed AC motor delivering about 7.5 h.p. Pump 43 and motor 45 are mounted on the chassis 82 of a trailer 83 which has wheels 84 and a tongue 85 whereby it can be towed to a jobsite as needed. Hydraulic pump 43, which takes the form of a commercially available pump capable of fluid pressure on the order of 1000 p.s.i, is mounted on a hydraulic fluid reservoir or tank 86 from which it receives and to which it returns such fluid during operation through internal connections (not shown). Pump 43 comprises a fluid pressure port 88 and a fluid return port 87 which are connected to one end of the passages 90 and 91 of a first check valve assembly 50. The other end of the passages 90 and 91 are connected, through interconnecting circuit lines 54 and 55, respectively, to the upper ends of the hydraulic fluid lines 72 and 73 from the submersible pump 40. The passages 90 and 91 are provided with pilot-operated check valves 92 and 93, respectively, poled as shown in FIG. 3. Check valve 92 allows fluid flow from pump port 88, through supply passage 90, check valve 92, line 55, supply line 72, into submersible pump port 70 and out port 71, through return line 73, line 54, return passage 91 and through check valve 93 and return passage 91 to pump port 87. Check valve 93 opens to permit such return flow whenever there is pressure from supply passage 90 in a pilot passage 94 indicating that pump unit 44 is in operation. However, the check valves 92 and 93 operate to prevent back-flow from the interconnecting lines 54 and 55 entering pump 43 when the standby pump unit 46 is in operation and main pump unit 44 is shut down.

As FIGS. 1, 2, 3, and 7 show, the standby engine driven hydraulic pump unit 46 comprises a hydraulic pump 47 which is connected to be driven by an internal combustion engine 49, such as a gasoline engine, a diesel engine, a propane or alcohol fueled engine, or even a gas turbine or the like. Engine 49 as shown takes the form of a commercially available variable speed gasoline engine delivering about 7.5 h.p. Pump 47 and engine 49 are mounted on the chassis 182 of a trailer 183 which has wheels 184 and a tongue 185 whereby it can be towed to a jobsite as needed. Hydraulic pump 47, which takes the form of a commercially available pump capable of fluid pressure on the order of 1000 p.s.i., is mounted on a hydraulic fluid reservoir or tank 186 from which it receives and to which it returns such fluid during operation through internal connections (not shown). Pump 47 comprises a fluid pressure port 188 and a fluid return port 189 which are connected to one end of the passages 190 and 191 of a second check valve assembly 52. The other end of the passages 190 and 191 are connected, through interconnecting circuit lines 55 and 54, respectively, to the upper ends of the hydraulic fluid lines 72 and 73 from the submersible pump 40. The passages 190 and 191 are provided with pilot-operated check valves 192 and 193, respectively, poled as shown in FIG. 3. Check valve 192 allows fluid flow from pump port 188, through supply passage 190, check valve 192, line 55, supply line 72, into submersible pump port 70 and out port 71, through return line 73, line 54, return passage 191 and through check valve 193 and return passage 191 to pump port 189. Check valve 193 opens to permit such return flow whenever there is pressure from supply passage 190 in a pilot passage 194 indicating that pump unit 46 is in operation. However, the check valves 192 and 193 operate to prevent back-flow from the interconnecting lines 55 and 54 entering pump 47 when the main pump unit 44 is in operation and standby pump unit 46 is shut down.

As FIG. 3 shows, electric motor 45 of main hydraulic pump unit 44 is energizable for operation from a source of a.c. electrical power, such as a set of pole-mounted electric lines or wires 62 from a local electric utility. The wires 62 are connected by drop-lines 64 to a motor starter and controller 66 which is mounted on a support framework 100 on chassis 82 of trailer 83 and electrically connected to motor 45 by conductors 101. Motor starter and controller 66 is commercially available and conventional in construction and mode of operation and is understood to contain components (not shown), such as switches, relays, contactors, circuit breaker and so forth, necessary to enable starting, stopping and normal operation of motor 45. It is to be understood that controller 66 contains a relay 103 (see FIG. 3) which operates to turn the motor 45 on and off in response to signal information pertaining to the level of sewerage in wet well 18 received through a conductor wire or cable 104 which is connected to a logic circuit 106 in speed control circuit 60. Speed control circuit 60 is connected by cable 61 to the float switches 58, 56 and 59 which are located in wet well 18. Lowermost float switch 58 is located so that it operates to stop whichever pump unit 44 or 46 is in service whenever the sewerage level in wet well 18 descends to a level just above submersible pump 40 so that its intake port 75 always remains submerged. Intermediate float switch 56 is located so that it operates to start whichever pump unit 44 or 46 is in service whenever the sewerage level in wet well 18 rises to a level relatively near the upper end of the wet well. Operation of switch 58 or 56 in response to the sewerage level transmits appropriate signal information to logic circuit 106 in speed control 60 and the logic circuit operates to maintain whichever pump unit 44 or 46 is in service either "on" or "off" until the next appropriate signal is received, regardless of switch condition. For example, if switch 56 closes when the sewerage level rises and starts a pump unit 44 or 46, the pump unit remains in operation even after switch 56 re-opens as the sewerage descends.

Uppermost float switch 59 is located so that it operates to indicate that wet well 18 is near overflow condition because submersible pump 40 is not in operation as a result of an electrical utility power failure which has disabled or prevented main pump unit 44 from operating. Switch 59 operates, through speed control 60 and the logic circuit 106 therein, to effect automatic start-up of engine 49 of standby pump unit 46 so as to place the latter unit in service. When unit 46 is in service, it responds to operation of the float switches 56 and 58, as hereinbefore described. That is to say, the engine 49 is turned off and restarted as conditions require for as long as unit 46 is in service. Speed control unit 60 automatically operates a switch 109 to energize starter motor 110 for engine 49 from a battery 112.

It is to be understood that the main pump unit 44 could take the form of a mobile hydraulic power unit No. M-48 manufactured by Sloan Pump Company, Incorporated, 4201 Kean Road, Fort Lauderdale, Fla. 33314. Similarly, the standby pump unit 46 could take the form of a mobile hydraulic power unit No. M-48 also manufactured by the aforementioned Sloan Pump Company, Incorporated. The reservoirs 86 and 186 and the hydraulic pumps 43 and 47 hereinbefore referred to are understood to be provided with components such as the following (which are not shown) but are necessary or desirable: hydraulic pressure relief valves, hydraulic filters, pressure gauges, sight gauges, manually operable shut-off valves and so forth. Similarly, the engine 49 for standby pump unit 46 contains components (not shown) which are normally part of or appurtenant to an internal combustion engine. The motor controller 66 employs known components (not shown) necessary to effect starting, stopping and running of electric motor 45. The controller 60 and its logic circuit 106 also employ known circuitry and components (not shown) for effecting, in response to operation of the float switches, 56, 58 and 59, effective control of electric motor 45 and internal combustion engine 49.

I claim:

1. Sewerage pumping apparatus for delivering sewerage from a wet well to another portion of a sewerage system comprising:

a submersible hydraulic pump for disposition in said wet well;

an electrically driven main pump unit for supplying pressurized hydraulic fluid to operate said submersible pump, said main pump unit being dependent on an electrical power supply from a utility to remain in service;

an engine driven standby pump unit alternately available for supplying pressurized hydraulic fluid to operate said submersible pump when said main pump unit is out of service because of power failure of said electrical power supply;

means responsive to said power failure to place said standby pump unit in service and in readiness to effect operation of said submersible pump;

and a hydraulic circuit connected between said submersible pump and both of said pump units, and check valves means in said hydraulic circuit for preventing the in-service pump unit from delivering hydraulic fluid to the out-of-service pump unit.

2. Sewerage pumping apparatus according to claim 1 including means for sensing the sewerage level in said wet well and for regulating the operation of whichever pump unit is in service so as to operate said submersible pump so as to maintain the level of sewerage in said wet well within a predetermined range.

3. Sewerage pumping apparatus for delivering sewerage from a wet well to a force main in a sewerage system comprising:

a submersible pump including a hydraulic drive motor for disposition in said wet well for supplying sewerage to said force main;

a main pump unit including an electric motor and pump for supplying pressurized hydraulic fluid to operate said submersible pump;

a standby pump unit including an internal combustion engine and pump for supplying pressurized hydraulic fluid to operate said submersible pump in the event said main pump unit is rendered inoperative because of a failure of an electrical power supply which energizes said motor of said main pump unit;

means responsive to said electrical power supply failure to start said engine of said standby pump unit to maintain said submersible pump in operation; and a hydraulic circuit connected between said hydraulic drive motor of said submersible pump and the pumps of both of said pump units, and further including check valve means in said hydraulic circuit for preventing the in-service pump unit from delivering hydraulic fluid to the out-of service pump unit.

4. Sewerage pumping apparatus according to claim 3 including means for sensing the sewerage level in said wet well and for regulating the on/off operation of whichever pump is in service so as to adjust the output of said submersible pump and maintain the sewerage at a safe level.

* * * * *